US005888053A

United States Patent [19]

Kobayashi et al.

[11] Patent Number: 5,888,053

[45] Date of Patent: Mar. 30, 1999

[54] PUMP HAVING FIRST AND SECOND OUTER CASING MEMBERS

[75] Inventors: Makoto Kobayashi; Masakazu Yamamoto; Yoshio Miyake; Koji Isemoto; Kaoru Yagi; Keita Uwai; Yoshiaki Miyazaki; Katsuji Iijima, all of Fujisawa; Junya Kawabata, Tokyo, all of Japan

[73] Assignee: Ebara Corporation, Tokyo, Japan

[21] Appl. No.: 598,651

[22] Filed: Feb. 8, 1996

[30] Foreign Application Priority Data

Feb. 10, 1995 [JP] Japan ..... 7-046356
Oct. 31, 1995 [JP] Japan ..... 7-306937

[51] Int. Cl.[6] ..... F04B 35/04; F04B 17/00

[52] U.S. Cl. ..... 417/244; 417/350; 417/365; 417/423.3; 417/423.5; 417/423.14

[58] Field of Search ..... 417/244, 350, 417/365, 423.3, 423.5, 423.11, 423.12, 423.14, 424.1

[56] References Cited

U.S. PATENT DOCUMENTS

| | | | |
|---|---|---|---|
| 1,071,042 | 8/1913 | Fuller | 417/423.5 |
| 1,823,455 | 9/1931 | Kirgan . | |
| 2,814,254 | 11/1957 | Litzenberg . | |
| 3,975,117 | 8/1976 | Carter . | |
| 4,105,372 | 8/1978 | Mishina et al. | 417/244 |
| 5,040,949 | 8/1991 | Crinquette et al. | 417/251 |
| 5,385,444 | 1/1995 | Kobayashi et al. . | |
| 5,388,971 | 2/1995 | Kobayashi et al. . | |
| 5,401,146 | 3/1995 | Moriya et al. . | |
| 5,478,215 | 12/1995 | Kobayashi et al. . | |
| 5,494,403 | 2/1996 | Kobayashi et al. . | |
| 5,494,418 | 2/1996 | Moriya et al. . | |
| 5,616,013 | 4/1997 | Kobayashi et al. | 417/423.11 |

FOREIGN PATENT DOCUMENTS

| | | |
|---|---|---|
| 0 406 787 | 1/1991 | European Pat. Off. . |
| 0 566 089 | 10/1993 | European Pat. Off. . |
| 0 634 827 | 1/1995 | European Pat. Off. . |
| 0 648 934 A1 | 4/1995 | European Pat. Off. . |
| 637 185 | 7/1983 | Switzerland . |
| 2 007 770 | 5/1979 | United Kingdom . |
| 2 036 869 | 7/1980 | United Kingdom . |

OTHER PUBLICATIONS

Patent Abstracts of Japan, vol. 9, No. 14 (M–352) [1737], Jan. 22, 1985, JP–A–59 162388, Sep. 13, 1984.

*Primary Examiner*—Charles G. Freay
*Attorney, Agent, or Firm*—Oblon, Spivak, McClelland, Maier & Neustadt, P.C.

[57] ABSTRACT

A pump having an improved fluid passage has an inner casing which houses at least one impeller and an outer casing which houses the inner casing. The pump also has a communicating pipe disposed outside of the outer casing for guiding a main flow of a fluid being handled from a space defined in the outer casing into another space defined in the outer casing.

18 Claims, 8 Drawing Sheets

PUMP HAVING FIRST AND SECOND OUTER CASING MEMBERS

BACKGROUND OF THE INVENTION

1. Field of the Invention

The present invention relates to a pump having an improved fluid passage, and more particularly to a pump having an outer casing which houses a pump section or a motor.

2. Description of the Related Art

There have heretofore been known pumps having an outer casing which houses a pump or a motor. For example, a full-circumferential-flow pump disclosed in Japanese laid-open patent publication No. 6-10890 includes an outer casing of sheet metal which encloses a motor therein.

The outer casing of such a pump holds a fluid being handled on its inner surface and also houses a pump or a motor for protecting the same. A sealing member is disposed on the inner surface of the outer casing for preventing a fluid under discharge pressure from leaking into a region under suction pressure. This structure is well suited to pumps which handle a simple fluid flow therein. Specifically, the main flow of a fluid which is being handled by such a pump flows only in one direction in the outer casing after the fluid is introduced into the outer casing until it is discharged out of the outer casing. Therefore, the pump operates highly efficiently without causing any undue pressure loss.

Furthermore, because the outer casing is of a relatively simple shape, it can easily be produced by pressing sheet metal.

However, the principles of the pump, which makes only the inner surface of the outer casing hold a fluid being handled, have resulted in a limitation posed on various structural possibilities. For example, if a balanced multistage pump were to have a fluid passage from a preceding stage to a subsequent stage within an outer casing, then the pump would be of a highly complicated structure, which would make it impossible to manufacture the pump as an actual product. Moreover, if a vertical multistage full-circumferential-flow pump of the normal type, rather than the balanced type, were arranged to discharge a fluid from a lower portion of an outer casing after the fluid has sufficiently cooled the motor, then it would be necessary to provide an annular fluid passage having a large passage area around the motor. Such an annular fluid passage would be undesirable as it would increase the outside diameter of the outer casing.

Further, there has heretofore been known a full-circumferential-flow double-suction-type pump which comprises a cylindrical outer motor frame disposed around the stator of a motor, an outer cylinder defining an annular space between the outer cylinder and an outer circumferential surface of the cylindrical outer motor frame, and laterally spaced pump sections mounted on respective opposite ends of the shaft of the motor for introducing a fluid being handled into the annular space.

In the known full-circumferential-flow double-suction-type pump, a fluid drawn in from a suction port flows into the pump section in which the fluid is introduced into respective impellers. The fluid flows discharged from the impellers then flow into the annular space between the outer cylinder and the cylindrical outer motor frame, and are combined with each other in the annular space. The combined fluid flow is then discharged from a discharge port defined in the outer cylinder.

The full-circumferential-flow double-suction-type pump is effective in canceling out thrust loads developed by the fluid and providing a suction capability particularly when the pump is operated at a high speed. However, since the pump is of the double suction type, it is not suitable for use as a pump for pumping a fluid at a very low flow rate. One effective way of realizing a centrifugal pump for pumping a fluid at a very low flow rate is to reduce the width of blades of an impeller in the pump. If the width of blades is reduced, however, the efficiency of the pump is lowered, and the impeller is subject to the danger of becoming clogged with foreign matter. In addition, a double-suction-type pump as a pump for pumping a fluid at a very low flow rate is more disadvantageous than a single-suction-type pump because the amount of fluid that is pumped by the double-suction-type pump is the sum of amounts of fluid discharged from both impellers thereof.

SUMMARY OF THE INVENTION

It is therefore an object of the present invention to provide a pump which has a relatively simple structure in an outer casing, but allows itself to be designed in a wide range of pump configurations including a balanced multistage pump.

Another object of the present invention is to provide a pump which has a required fluid passage area and is relatively small in size without the need for an increase in the general outside diameter of an outer casing.

Still another object of the present invention is to provide a multistage full-circumferential-flow canned-motor pump which has a common shaft serving as both a motor shaft and a pump shaft, the pump being capable of pumping a fluid at a low flow rate under a high pump head.

Still another object of the present invention is to provide a balanced multistage pump with a simple arrangement for canceling out radial loads.

Still another object of the present invention is to provide a full-circumferential-flow single-suction-type pump of simple structure which can cancel out axial thrust loads developed therein and can pump a fluid at a low flow rate under a high pump head.

Still another object of the present invention is to provide a pump which maintains a desired suction performance when it operated at high speed.

Still another object of the present invention is to provide a pump which cancel out radial loads developed therein.

To achieve the above objects, according to one aspect of the present invention, there is provided a pump having an improved fluid passage comprising: an outer casing; an inner casing provided in said outer casing; an impeller housed in said inner casing; and communicating means disposed outside of said outer casing for guiding a main flow of fluid from a space defined in said outer casing into another space defined in said outer casing.

With the above arrangement, the pump can be constructed as a balanced multistage pump for reducing axial thrust forces in order to be able to pump a fluid at a low rate under a high pump head.

The pump includes a canned motor having a can, and the impellers are arranged so as not to apply the discharge pressure developed by all the impellers directly to the can.

The balanced multistage pump also includes two single volutes held back to back, i.e., directed in opposite directions, for canceling out radial loads through a simple and compact arrangement.

The communicating means such as a communicating pipe or a case which is disposed outside of the outer casing can guide the fluid from a space in the outer casing into another space in the outer casing. This structure allows the pump to be constructed as a balanced multistage pump. If a general multistage pump includes the communicating means of the type described above, the outside diameter of the outer casing thereof can be reduced.

The outer casing has a first outer casing member which defines an annular fluid passage between the first outer casing member and an outer motor frame, and a second outer casing member mounted on at least one of the axial ends of the first outer casing member. The outer casing of this construction permits the pump to be constructed as a full-circumferential-flow pump which is highly silent operation and which can reduce noise even when it is operated at high speed through the use of a frequency converter, etc. Depending on the piping connected to the pump, the communicating pipe may be mounted on either one of the first and second outer casing members with slight modifications possibly made therein for attaching the communicating pipe. Accordingly, the pump can be adapted to different conditions in which it is used.

The communicating pipe is mounted on an outer surface of the outer casing. The outer casing is generally constructed such that its outer and inner surfaces are made of the same material. Since no problem arises when the fluid being handled by the pump is brought into contact with the outer surface of the outer casing as well as the inner surface thereof, the outer surface of the outer casing serves as part of a fluid passage defined by the communicating pipe. As a result, the amount of material used to manufacture the pump can be saved, and the pump can be reduced in size.

It is most preferable to make the outer casing of sheet metal and weld the communicating pipe to the outer casing. The outer casing of sheet metal has sufficient mechanical strength, but is not rigid enough and hence tends to vibrate during operation of the pump. However, since the communicating pipe is welded to the outer casing, the outer casing is made rigid enough by the welded communicating pipe and is prevented from undue vibration when the pump is operated. Because communication holes to be connected by the communicating pipe can easily be formed in the outer casing and the communicating pipe can simply be welded to the outer casing, the outer casing can efficiently be fabricated.

In the case where the impellers include the preceding- and subsequent-stage impellers and the communicating pipe is arranged to guide the fluid from the preceding-stage impeller toward the subsequent-stage impeller, the pump can be constructed as a balanced multistage pump.

If the impellers include an impeller for generating an opposite axial thrust force, then the entire thrust force produced by the pump can be reduced.

The canned motor includes a shaft and a rotor mounted on the shaft and rotatably disposed in a stator. The impellers include an impeller mounted on an end of the shaft and having a suction mouth opening in a first direction, and another impeller mounted on an opposite end of the shaft and having a suction mouth opening in a second direction opposite to the first direction. Since the impellers are distributed on the opposite axial end portions of the shaft, the number of impellers mounted on one axial end of the shaft is reduced. Therefore, the overhang of the shaft from each of the bearing assemblies to the corresponding axial end is reduced, and the pump has increased mechanical stability.

Because the pump incorporates the canned motor, it requires no shaft seal devices, and prevents the fluid from leaking out of the outer casing even when a high pressure is developed in the outer casing during the operation of the multistage pump.

Furthermore, the impellers are arranged such that the total discharge pressure developed by all the impellers is not directly applied to the can of the canned motor. The pressure resistance of the canned motor depends roughly on the mechanical strength of the can. In the present invention, the discharge pressure from the final-stage impeller, i.e., the total discharge pressure from all the impellers, is not applied to the can. In embodiments shown in FIGS. 1 and 3, for example, the discharge pressure developed by only two of the impellers is imposed on the can. In an embodiment shown in FIG. 4, the discharge pressure of any of the impellers is not applied to the can. Since the impellers are arranged to prevent the can from being exposed to an unduly high fluid pressure, the canned motor may be of a relatively low pressure resistance and the pump can be operated even if it develops a high fluid pressure.

Furthermore, two single volutes associated with the respective impellers which have oppositely directed suction mouths, and are 180° spaced from each other around the shaft for canceling out radial loads developed by the fluid discharged by the impellers. The single volutes are employed because they are effective to guide the fluid more smoothly into the communicating pipe and a discharge pipe that are 180° spaced from each other than guide vanes which would be used to guide the fluid.

If the two single volutes are integrally formed with each other as a unitary component, then they are accurately 180° spaced from each other to prevent radial loads from being developed which would otherwise tend to occur if the single volutes were not accurately positioned in 180° spaced-apart relationship. A shaft seal which is positioned in an axial hole defined through the single volutes provides a compact seal structure which is effective to prevent the fluid from leaking.

According to the present invention, a pump may have a single-suction-type multistage pump section and a plurality of impellers which include at least one impeller whose suction mouth opens in a direction opposite to the direction in which the suction mouths of the other impellers open. If the number of impellers whose suction mouths open in the same direction were simply increased, then axial thrust forces would also be increased in proportion to the number of impellers. Therefore, the capacity of thrust bearings used should be determined in view of the maximum number of impellers that can be incorporated.

The axial thrust forces may be reduced in various ways which include providing a balance hole. For canceling out axial thrust forces themselves, it is most effective to provide impellers whose suction mouths open in different directions. There has heretofore been available no balanced multistage pump incorporated in a full-circumferential-flow pump.

The full-circumferential-flow pump is suitable for use as a small-size pump which rotates at a high speed of at least 4000 rpm through the use of a frequency converter or the like. Noise and vibrations which are caused by the pump when it is operated at such a high speed can be absorbed and attenuated by a fluid which is being handled by the pump.

Design specifications of thrust bearings are determined by a PV value, i.e., (a sliding surface pressure)×(a sliding speed). Upon high-speed rotation, the sliding surface pressure needs to be lowered because the sliding speed is high, i.e., axial thrust forces need to be reduced. Therefore, it is highly significant to construct a balanced multistage pump in the form of a full-circumferential-flow pump.

If the motor employs a cylindrical outer motor frame of sheet metal, then the cylindrical outer motor frame tends to transmit strains inwardly when irregular pressures are applied to its outer surface. Consequently, it is preferable to define an annular space between the cylindrical outer motor frame and the outer casing for keeping a uniform pressure in the annular space.

In the embodiment shown in FIGS. 1 and 2, the pump is arranged such that substantially identical fluid pressures are developed at the opposite axial ends of the rotor of the canned motor. If different pressures were developed at the opposite axial ends of the rotor, an axial thrust force would be produced due to the difference between the pressures acting on the opposite axial ends of the rotor, thus impairing the effectiveness of the balanced multistage pump.

According to another aspect of the present invention, there is provided a pump having an improved fluid passage comprising: an outer casing; a motor housed in said outer casing, said motor including a stator and a cylindrical outer motor frame fitted over said stator and fixedly supported in said outer casing; an annular space defined between said outer casing and said cylindrical outer motor frame; an inner casing provided in said outer casing; and a pump section having at least one impeller disposed in said inner casing; wherein said inner casing has a suction passage defined therein in communication with said annular space for introducing fluid into said pump section, and said inner casing and said outer casing define a discharge passage therebetween for discharging the fluid from said pump section.

The inner casing disposed in the outer casing of the pump, which is constructed as a full-circumferential-flow pump, and housing the impeller has the suction passage for guiding the fluid to the suction mouth of the impeller. The discharge passage defined between the inner casing and the outer casing serves to guide the fluid to flow discharged from the impeller toward the outside of the outer casing. This fluid passage arrangement results in a structure for balancing axial thrust forces in the pump.

If a full-circumferential-flow single-suction-type multistage pump is to balance axial thrust forces with impellers having respective suction mouths opening in opposite directions, then it is necessary for the pump to have a fluid passage interconnecting the preceding-stage pump section and the subsequent-stage pump section. Such a fluid passage may be provided by delivering a fluid discharged from the preceding-stage pump section to the subsequent-stage pump section through a pipe. However, such a system needs a pipe and is relatively complex in structure.

According to the present invention, the inner casing has the suction passage for guiding the fluid flowing from the motor-side to the suction mouth of the impeller section which is located remotely from the motor, and the discharge passage defined between the inner casing and the outer cylinder serves to guide the fluid discharged from the impeller toward the outside of the outer cylinder. This fluid passage arrangement allows the pump to be easily constructed as a balanced single-suction-type multistage pump.

If a single-suction-type pump is to be operated at a high speed through the use of an inverter or the like, then it is important for the pump to keep a desired suction performance. According to the present invention, a first-stage impeller has a larger design-point flow rate or capacity than any of other impellers. Specifically, the first-stage impeller has a suction mouth diameter which is larger than the suction mouth diameter of any of the other impellers, and the first-stage impeller has blades having a width larger than the width of blades of the other impellers. Generally, a comparison between impellers having identical outside diameters but different suction mouth diameters indicates that the impeller with the greater suction mouth diameter has a better suction performance than the impeller with the smaller suction mouth diameter at the same flow rate point. The overall flow rate of a multistage pump is substantially governed by an impeller having a smaller flow rate which is incorporated therein. Therefore, it is possible for the single-suction-type pump which is operated at a high speed to keep a desired suction performance.

It is also of importance for a pump which is operated at a high speed to cancel out axial thrust forces as well as to balance radial loads. If the pump is operated at a high speed while bearings of the pump are being subjected to radial loads, then the bearings tend to wear soon. Accordingly, the pump is required to be of such a structure capable of balancing and canceling out radial loads.

According to the present invention, such radial loads are canceled out by employing a double volute construction composed of discharge volutes associated with the final-stage impeller in the inner casing, and also by constructing a return blade and a guide unit associated with the other impellers as volutes or guide vanes.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
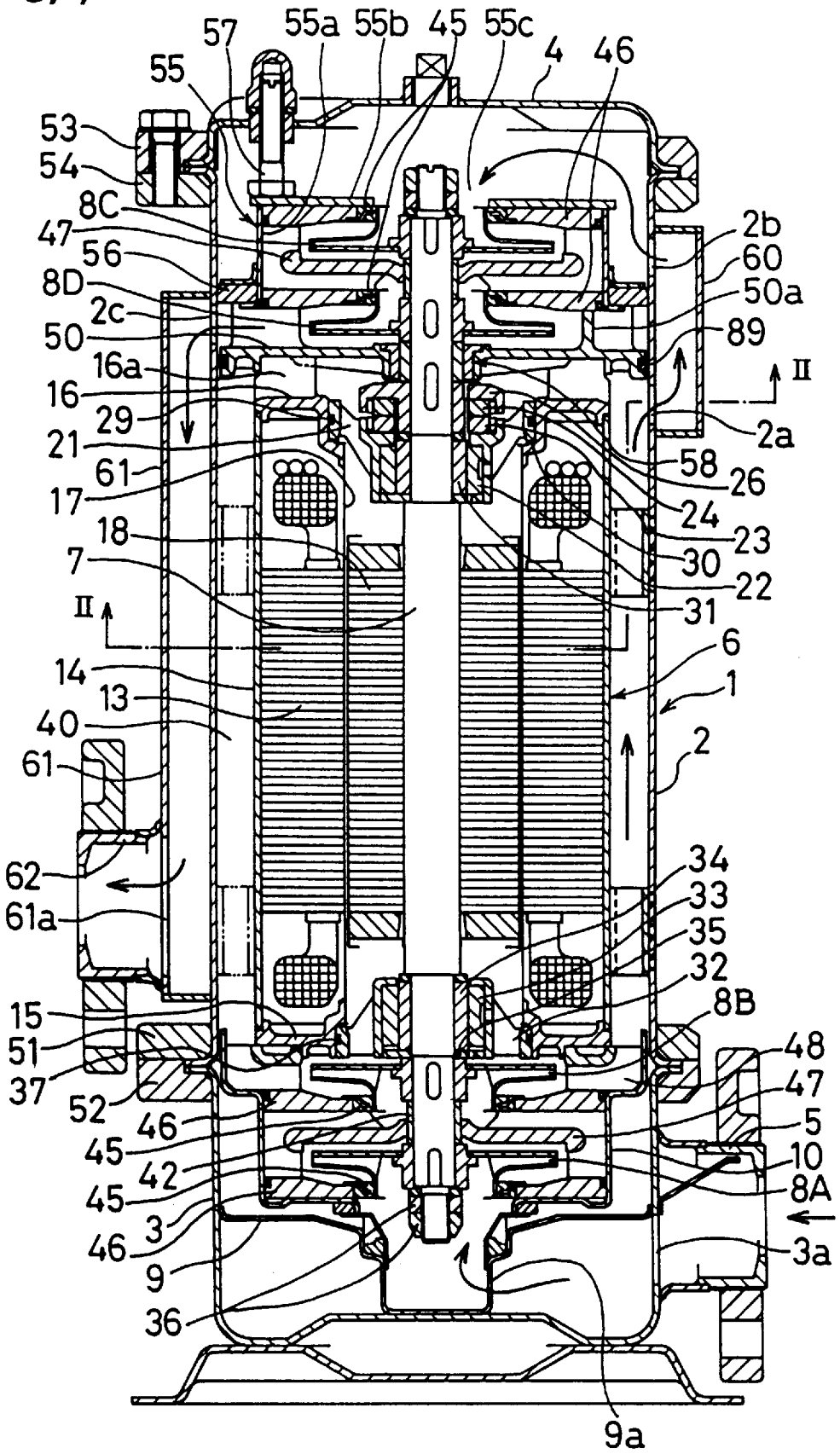
FIG. 1 is a vertical cross-sectional view of a pump according to a first embodiment of the present invention.

Like or corresponding parts are denoted by like or corresponding reference numerals throughout views.

Figure 2:
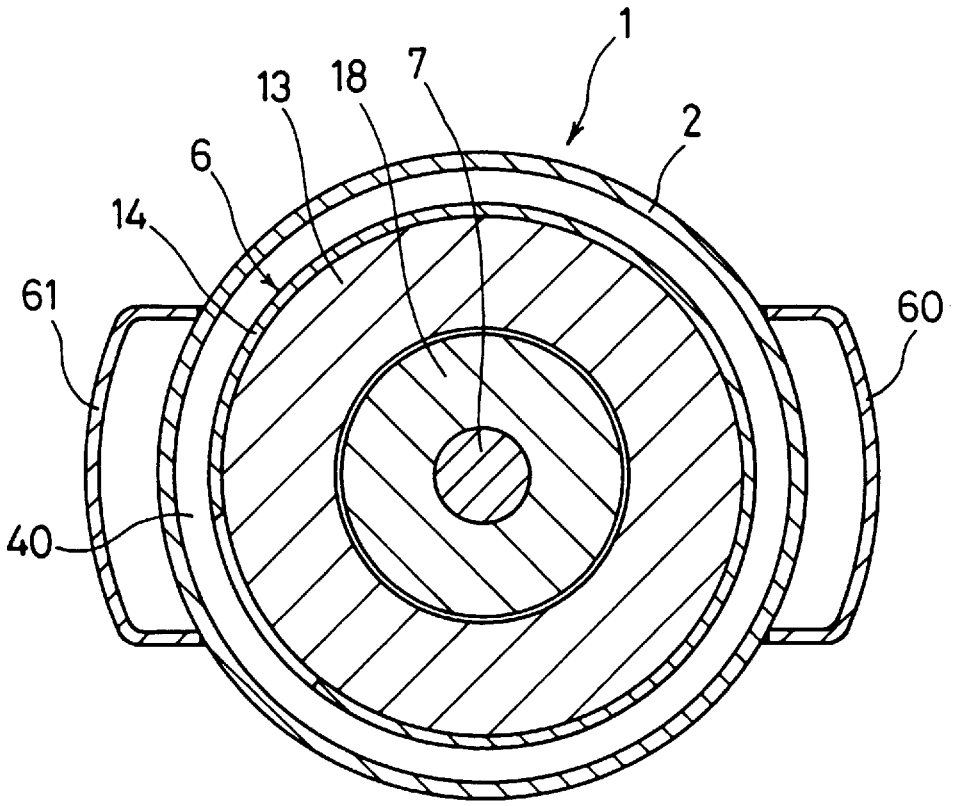
FIG. 2 is a cross-sectional view taken along line II—II of FIG. 1.

FIGS. 1 and 2 show a pump according to a first embodiment of the present invention, the pump being constructed as a vertical multistage pump.

The vertical multistage pump has a cylindrical pump casing 1 which houses a canned motor 6 positioned centrally therein. As shown in FIG. 1, the canned motor 6 has a main shaft 7 extending vertically and supporting on its opposite end portions respective pairs of lower impellers 8A, 8B and upper impellers 8C, 8D. The lower impellers 8A, 8B have respective suction mouths which are open axially downwardly, and the upper impellers 8C, 8D have respective suction mouths which are open axially upwardly. The impellers 8A, 8B, 8C, 8D will also be referred to as first-, second-, third-, and fourth- or final-stage impellers, respectively.

The pump casing 1 comprises an outer cylinder 2 of sheet stainless steel, a suction casing 3 of sheet stainless steel joined to a lower end of the outer cylinder 2 by flanges 51, 52, and a cover 4 of sheet stainless steel joined to an upper end of the outer cylinder 2 by flanges 53, 54. The suction casing 3 has a suction mouth 3*a* defined in a side wall thereof, and a suction nozzle 5 is fixed to the side wall of the suction casing 3 around the suction port 3*a* and projects radially outwardly. A partition wall 9 is fixedly mounted in the suction casing 3 diametrically across the lower end of the main shaft 7 and has a suction opening 9*a* defined in a central axial boss thereof in communication with the suction mouth of the first-stage impeller 8A.

The suction casing 3 accommodates an inner casing 10 axially spaced from the partition wall 9 and housing the lower impellers 8A, 8B therein, which are axially spaced from each other. The inner casing 10 also houses therein a pair of axially spaced retainers 46 positioned underneath the lower impellers 8A, 8B, respectively, and retaining respective liner rings 45 disposed around respective suction mouths of the lower impellers 8A, 8B, a return blade 47 positioned axially between the impeller 8A and the upper retainer 46 located underneath the impeller 8B, for guiding a fluid discharged from the first-stage impeller 8A upwardly toward the second-stage impeller 8B, and a guide unit 48 positioned above the upper retainer 46 and extending around the impeller 8B, for guiding a fluid discharged radially outwardly from the second-stage impeller 8B to flow axially upwardly.

The canned motor 6 comprises a stator 13, a cylindrical outer motor frame 14 fitted over the stator 13, a pair of axially spaced side frame plates 15, 16 welded respectively to axially opposite open ends of the outer motor frame 14, and a cylindrical can 17 fitted in the stator 13 and having axially opposite ends welded to the side frame plates 15, 16. The canned motor 6 also has a rotor 18 rotatably housed in a rotor chamber defined in the can 17 in radial alignment with the stator 13 and shrink-fitted over the main shaft 7. The outer motor frame 14 is fixedly supported in and spaced radially inwardly of the outer cylinder 2 with an annular fluid passage 40 defined therebetween.

The side frame plate 16 has a plurality of ribs 16*a* extending axially upwardly, and a radial partition wall 50 is supported on upper ends of the ribs 16*a* around the main shaft 7. The partition wall 50 has a seal member 89 at the outer periphery thereof. The partition wall 50 has a volute 50*a* extending in surrounding relationship to the fourth-stage or final-stage impeller 8D, which is positioned below the third-stage impeller 8C. The partition wall 50 has a socket defined in its upper end. The third-stage impeller 8C is housed in an inner casing 55 which is positioned in an upper end portion of the outer cylinder 2 and has a lower end fitted in the socket of the partition wall 50. The partition wall 50 supports on its inner end a shaft seal 58 disposed around the main shaft 7 for preventing the fluid from leaking along the main shaft 7.

The inner casing 55 is of a substantially cylindrical-cup shape and comprises a cylindrical wall 55*a* and an upper end cover 55*b* joined to an upper end of the cylindrical wall 55*a*. A resilient annular seal 56 is fixed to and extends around a lower end of the cylindrical wall 55*a*. The resilient annular seal 56 is held against an inner surface of the outer cylinder 2 for preventing a fluid being handled from leaking from a discharge region back into a suction region in the pump. The cover 55*b* has a central suction opening 55*c* defined therein in communication with the suction mouth of the third-stage impeller 8C.

The inner casing 55 and the partition wall 50 are supported on the side frame plate 16 by a bolt 57 which is fastened to the cover 4 and presses the inner casing 55 axially downwardly. The inner casing 55 houses therein a pair of axially spaced retainers 46 positioned above the upper impellers 8C, 8D, respectively, and retaining respective liner rings 45 disposed around respective suction mouths of the upper impellers 8C, 8D, and a return blade 47 positioned axially between the impeller 8C and the lower retainer 46 located above the impeller 8D, for guiding a fluid discharged from the third-stage impeller 8C downwardly toward the final-stage impeller 8D. The retainers 46 and the return blade 47 housed in the inner casing 55 are identical to the retainers 46 and the return blade 47 housed in the inner casing 10.

The outer cylinder 2 has a pair of axially spaced communication holes 2*a*, 2*b* defined in an upper portion thereof. The communication holes 2*a*, 2*b* are connected to each other by a communicating pipe or case 60 (see also FIG. 2) which is welded to an outer circumferential surface of the outer cylinder 2 in covering relationship to the communication holes 2*a*, 2*b*. The outer cylinder 2 also has a discharge window 2*c* defined in an upper portion thereof in diametrically opposite relationship to the communication holes 2*a*, 2*b*. The discharge window 2*c* is covered with a discharge pipe or case 61 which is welded to an outer circumferential surface of the outer cylinder 2. The discharge pipe 61 extends downwardly to a lower portion of the outer cylinder 2, and has a discharge port 61*a* defined in a lower end thereof. A discharge nozzle 62 is fixed to a lower side wall of the discharge pipe 61 around the discharge port 61*a* and projects radially outwardly.

The main shaft 7 is rotatably supported by upper and lower bearing assemblies disposed in the rotor chamber and positioned on respective upper and lower end portions thereof. The upper and lower bearing assemblies can be lubricated by a flow of the fluid which is introduced into the rotor chamber of the canned motor 6.

The upper bearing assembly, which is positioned closely below the upper impellers 8C, 8D, comprises a bearing bracket 21 which supports a radial bearing 22 and a fixed thrust bearing 23 that is positioned above and adjacent to the radial bearing 22. The radial bearing 22 has an end face doubling as a fixed thrust sliding member. The upper bearing assembly also includes a rotatable thrust bearing 24 as a rotatable thrust sliding member positioned above and axially facing the fixed thrust bearing 23. The rotatable thrust bearing 24 is fixed to a thrust disk 26 mounted on the main shaft 7.

The bearing bracket 21 is inserted in a socket in the side frame plate 16 through a resilient O-ring 29. The bearing bracket 21 is axially held against the side frame plate 16 through a resilient gasket 30. The radial bearing 22 is slidably mounted on a sleeve 31 which is mounted on the main shaft 7.

The lower bearing assembly, which is positioned closely above the lower impellers 8A, 8B, includes a bearing bracket 32 supporting a radial bearing 33 that is slidably mounted on a sleeve 34 which is mounted on the main shaft 7. The sleeve 34 is axially held against a washer 35 which is fixed to a lower end portion of the main shaft 7 through the impeller 8B, the sleeve 42, and the impeller 8A by a screw and nuts 36 threaded over the lower end of the main shaft 7. The bearing bracket 32 is inserted in a socket in the side frame plate 15 through a resilient O-ring 37. The bearing bracket 32 is axially held against the side frame plate 15.

Operation of the vertical multistage pump shown in FIGS. 1 and 2 will be described below.

A fluid which is drawn in through the suction nozzle 5 and the suction port 3*a* flows through the suction opening 9*a* into the first- and second-stage impellers 8A, 8B, which increase the pressure of the fluid. The fluid which is discharged radially outwardly from the second-stage impeller 8B is guided by the guide unit 48 to flow axially upwardly. The fluid is then introduced upwardly into the annular fluid passage 40 between the outer cylinder 2 and the cylindrical outer motor frame 14, and then flows from the annular fluid passage 40 through the communication hole 2*a*, the communicating pipe 60, the communication hole 2*b* into a space defined between the cover 4 and the upper end of the outer cylinder 2. The fluid then flows into the third- and final-stage impellers 8C, 8D, which increase the pressure of the fluid. The fluid which is discharged by the final-stage impeller 8D is guided by the volute 50*a*, and discharged through the discharge window 2*c* radially outwardly into the discharge pipe 61. The fluid then flows axially downwardly in the discharge pipe 61, and is discharged through the discharge port 61*a* and then through the discharged nozzle 62 out of the pump.

According to the first embodiment described above, the communicating pipe 60 welded to the outer circumferential surface of the outer cylinder 2 guides the fluid pressurized by the impellers 8A, 8B to flow from the annular fluid passage 40 into the other space in the outer cylinder 2, from which the fluid is introduced into the impellers 8C, 8D. This structure allows the vertical multistage pump to be constructed as a balanced multistage pump.

The pump casing 1 includes an outer casing which has a first outer casing member composed of the outer cylinder 2 which defines the annular fluid passage 40 between itself and the outer motor frame 14, and a second outer casing member composed of the suction casing 3 or the cover 4 which is mounted on at least one of the axial ends of the outer cylinder 2. The pump casing 1 of this construction permits the vertical multistage pump to be constructed as a full-circumferential-flow pump which is highly silent in operation and which can reduce noise even when it is operated at high speed through the use of a frequency converter or the like. Depending on the piping connected to the pump, the communicating pipe 60 may be mounted on either one of the first and second outer casing members with slight modifications possibly made therein for attaching the communicating pipe 60. Accordingly, the pump can be adapted to different conditions in which it is used.

The communicating pipe 60 is mounted on the outer circumferential surface of the outer cylinder 2. The outer cylinder 2 is generally constructed such that its outer and inner surfaces are made of the same material. Since no problem arises when the fluid being handled by the pump is brought into contact with the outer surface of the outer cylinder 2 as well as the inner surface thereof, the outer surface of the outer cylinder 2 serves as part of a fluid passage defined by the communicating pipe 60. As a result, the amount of material used to manufacture the pump can be saved, and the pump can be reduced in size.

It is most preferable to make the outer cylinder 2 of sheet metal and weld the communicating pipe 60 to the outer cylinder 2. The outer cylinder 2 of sheet metal has sufficient mechanical strength, but is not rigid enough and hence tends to vibrate during operation of the pump. However, since the communicating pipe 60 is welded to the outer cylinder 2, the outer cylinder 2 is made rigid enough by the welded communicating pipe 60 and is prevented from undue vibration when the pump is operated. Because the communication holes 2*a*, 2*b* can easily be formed in the outer cylinder 2 and the communicating pipe 60 can simply be welded to the outer cylinder 2, the pump casing 1 can efficiently be fabricated.

The vertical multistage pump can be constructed as a balanced multistage pump simply by installing the communicating pipe 60 which guides the fluid from the low-stage impellers 8A, 8B to the upper-stage impellers 8C, 8D.

The lower pair of impellers 8A, 8B and the upper pair of impellers 8C, 8D are arranged to generate opposite axial thrust forces, respectively. Inasmuch as opposite axial thrust forces are generated respectively by the lower pair of impellers 8A, 8B and the upper pair of impellers 8C, 8D, the entire axial thrust force developed in the pump is reduced.

Furthermore, the lower pair of impellers 8A, 8B and the upper pair of impellers 8C, 8D, which are mounted respectively on the opposite axial end portions of the main shaft 7, have oppositely directed suction mouths. Since the impellers are distributed on the opposite axial end portions of the main shaft 7, the number of impellers mounted on one axial end of the main shaft 7 is reduced as compared with another embodiment shown in FIG. 4 (described later on). Therefore, the overhang of the main shaft 7 from each of the bearing assemblies to the corresponding axial end is reduced, and the pump has increased mechanical stability.

Because the pump incorporates the canned motor 6, it requires no shaft seal devices, and prevents the fluid from leaking out of the pump casing 1 even when a high pressure is developed in the pump casing 1 during the operation of the multistage pump.

The impellers 8A, 8B, 8C, 8D are arranged such that the total discharge pressure developed by all the impellers 8A, 8B, 8C, 8D is not directly applied to the cylindrical can 17 of the canned motor 6. The pressure resistance of the canned motor 6 depends roughly on the mechanical strength of the can 17. In the first embodiment shown in FIGS. 1 and 2, the discharge pressure developed by only two of the impellers 8A, 8B, 8C, 8D is imposed on the can 17. Since the impellers 8A, 8B, 8C, 8D are arranged to prevent the can 17 from being exposed to an unduly high fluid pressure, the canned motor 6 may be of a relatively low pressure resistance and can operate the pump even if it develops a high fluid pressure.

As shown in FIGS. 1 and 2, the pump is arranged such that substantially identical fluid pressures are developed at the opposite axial ends of the rotor 18 of the canned motor 6. If different pressures were developed at the opposite axial ends of the rotor 18, an axial thrust force would be produced due to the difference between the pressures acting on the opposite axial ends of the rotor 18, impairing the effectiveness of the balanced multistage pump. However, the pump according to the first embodiment is free from such a problem.

Figure 3:
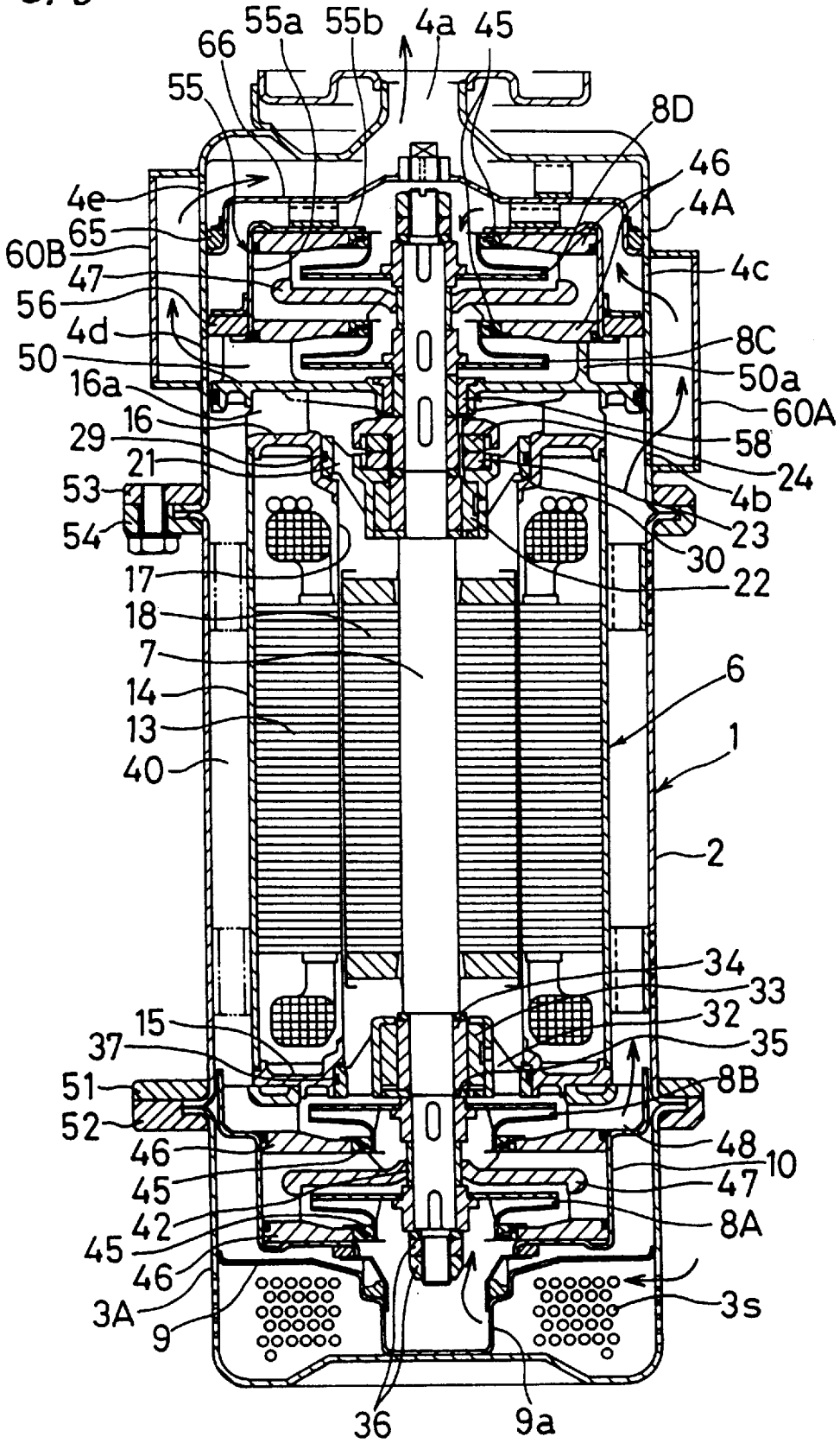
FIG. 3 is a vertical cross-sectional view of a pump according to a second embodiment of the present invention.

FIG. 3 shows a pump according to a second embodiment of the present invention, the pump being constructed as a submersible multistage pump. Those parts shown in FIG. 3 which are identical to those shown in FIG. 1 are denoted by identical reference numerals, and will not be described in detail below.

The submersible multistage pump comprises a cylindrical pump casing 1 with a canned motor 6 positioned centrally therein. The canned motor 6 has a main shaft 7 extending vertically and supporting on its opposite end portions respective pairs of lower impellers 8A, 8B and upper impellers 8C, BD. The lower impellers 8A, 8B have respective suction mouths which are open axially downwardly, and the upper impellers 8C, 8D have respective suction mouths which are open axially upwardly.

The pump casing 1 comprises an outer cylinder 2 of sheet stainless steel, a suction casing 3A of sheet stainless steel joined to a lower end of the outer cylinder 2 by flanges 51, 52, and a discharge casing 4A of sheet stainless steel joined to an upper end of the outer cylinder 2 by flanges 53, 54. The suction casing 3A has a strainer 3*s* defined in a side wall thereof. The discharge casing 4A has a discharge port 4*a* defined axially centrally therein. The discharge casing 4A also has a pair of axially spaced communication holes 4*b*, 4*c* defined in an upper portion thereof. The communication holes 4*b*, 4*c* are connected to each other by a communicating pipe or case 60A which is welded to an outer circumferential surface of the discharge casing 4A in covering relationship to the communication holes 4*b*, 4*c*. The discharge casing 4A also has another pair of axially spaced communication holes 4*d*, 4*e* defined in an upper portion thereof in diametrically opposite relationship to the communication holes 4*b*, 4*c*. The communication holes 4*d*, 4*e* are connected to each other by a communicating pipe or case 60B which is welded to an outer circumferential surface of the discharge casing 4A in covering relationship to the communication holes 4*d*, 4*e*. A partition wall 66 with an annular seal 65 supported on its outer circumferential edge is fixedly disposed in the discharge casing 4A diametrically across the upper end of the main shaft 7. Other structural details of the pump shown in FIG. 3 are the same as those of the pump shown in FIGS. 1 and 2.

The submersible multistage pump of the above structure operates as follows:

A fluid which is drawn in through the strainer 3*s* flows through the suction opening 9*a* into the first- and second-stage impellers 8A, BB, which increase the pressure of the fluid. The fluid which is discharged radially outwardly from the second-stage impeller 8B is guided by the guide unit 48 to flow axially upwardly. The fluid is then introduced upwardly into the annular fluid passage 40 between the outer cylinder 2 and the cylindrical outer motor frame 14, and then flows from the annular fluid passage 40 through the communication hole 4*b*, the communicating pipe 60A, the communication hole 4*c* into a space defined between the partition wall 66 and the inner casing 55. The fluid then flows into the third- and final-stage impellers 8C, 8D, which increase the pressure of the fluid. The fluid which is discharged by the final-stage impeller 8D is guided by the volute 50*a*, and flows through the communication hole 4*d*, the communicating pipe 60B, the communication hole 4*e* into a space defined between the discharge casing 4A and the partition wall 66. Thereafter, the fluid is discharged through the discharge port 4*a* of the discharge casing 4A out of the pump.

According to the second embodiment, the communicating pipes 60A, 60B welded to the outer circumferential surfaces of the discharge casing constituting an outer casing guide the fluid pressurized by the impellers 8A, 8B to flow from the annular fluid passage 40 into the impellers 8C, 8D, and also guide the fluid discharged from the final-stage impeller 8D to flow into the discharge port 4*a* of the discharge casing 4A. This structure allows the submersible multistage pump to be constructed as a balanced multistage pump. Other advantages of the submersible multistage pump shown in FIG. 3 are the same as those of the pump shown in FIGS. 1 and 2.

Figure 4:
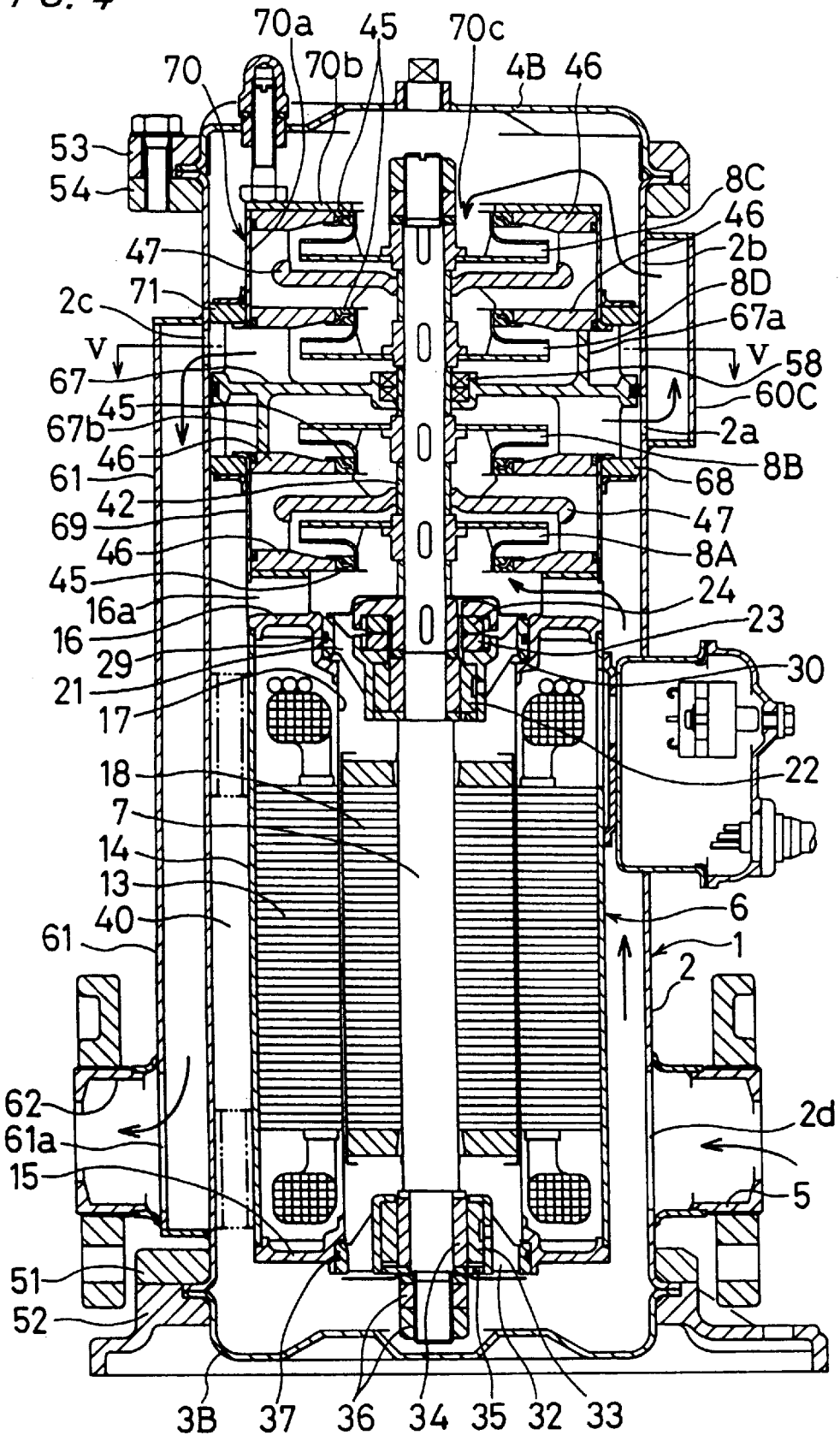
FIG. 4 is a vertical cross-sectional view of a pump according to a third embodiment of the present invention.
Figure 5:
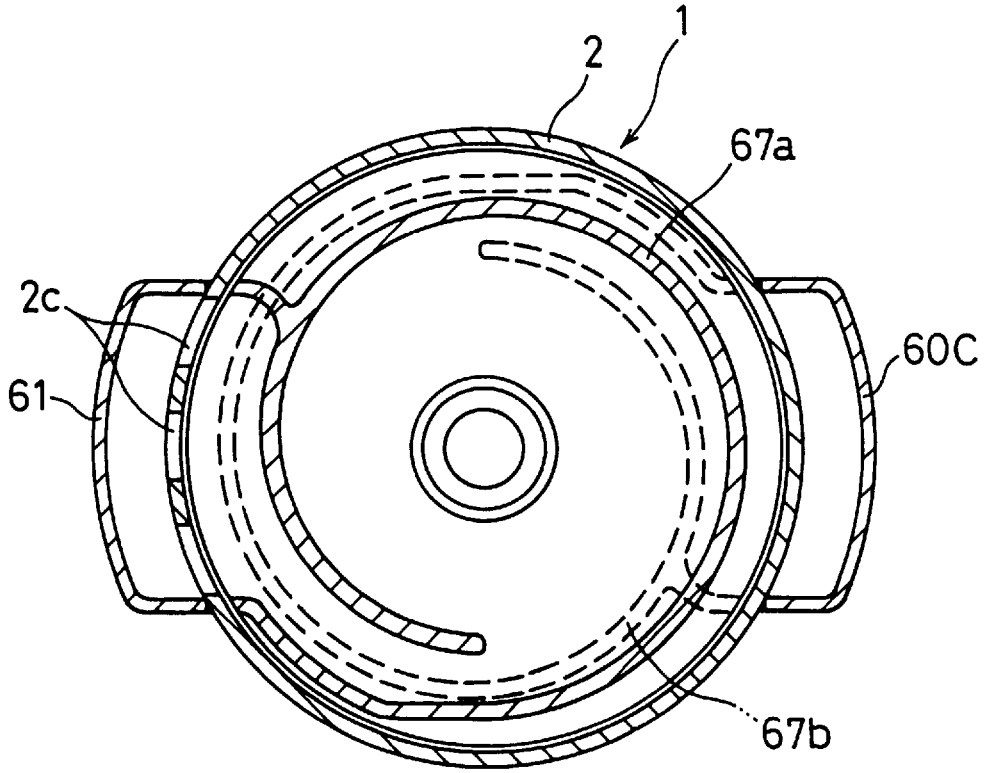
FIG. 5 is a cross-sectional view taken along line V—V of FIG. 1.

FIGS. 4 and 5 show a pump according to a third embodiment of the present invention, the pump being constructed as a vertical multistage pump. Those parts shown in FIG. 4 which are identical to those shown in FIG. 1 are denoted by identical reference numerals, and will not be described in detail below.

The vertical multistage pump has a cylindrical pump casing 1 which houses a canned motor 6 centrally therein. As shown in FIG. 4, the canned motor 6 has a main shaft 7 extending vertically and supporting on an upper end portion thereof a pair of lower impellers 8A, 8B and a pair of upper impellers 8C, 8D. The lower impellers 8A, 8B have respective suction mouths which are open axially downwardly, and the upper impellers 8C, 8D have respective suction mouths which are open axially upwardly.

The pump casing 1 comprises an outer cylinder 2 of sheet stainless steel, a cover 3B of sheet stainless steel joined to a lower end of the outer cylinder 2 by flanges 51, 52, and a cover 4B of sheet stainless steel joined to an upper end of the outer cylinder 2 by flanges 53, 54. The outer cylinder 2 has a suction port 2*d* defined in a lower side wall thereof, and a suction nozzle 5 is fixed to the side wall of the outer cylinder 2 around the suction port 2*d* and projects radially outwardly.

The outer cylinder 2 has a pair of axially spaced communication holes 2*a*, 2*b* defined in an upper portion thereof. The communication holes 2*a*, 2*b* are connected to each other by a communicating pipe or case 60C (see also FIG. 5) which is welded to an outer circumferential surface of the outer cylinder 2 in covering relationship to the communication holes 2*a*, 2*b*. The outer cylinder 2 also has a discharge window 2*c* defined in an upper portion thereof in diametrically opposite relationship to the communication holes 2*a*, 2*b*. The discharge window 2*c* is covered with a discharge pipe or case 61 which is welded to an outer circumferential surface of the outer cylinder 2. The discharge pipe 61 extends downwardly to a lower portion of the outer cylinder 2, and has a discharge port 61*a* defined in a lower end thereof. A discharge nozzle 62 is fixed to a lower side wall of the discharge pipe 61 around the discharge port 61*a* and projects radially outwardly.

A partition wall 67 is disposed between the second-stage impeller 8B and the fourth-stage impeller 8D. As shown in FIGS. 4 and 5, the partition wall 67 has a single volute 67*a*, indicated by the solid lines in FIG. 5, projecting upwardly toward the fourth-stage impeller 8D, and a single volute 67*b*, indicated by the broken lines in FIG. 5, projecting downwardly toward the second-stage impeller 8B. The volutes 67*a*, 67*b* have respective ends where they start and/or stop winding, which are positioned substantially diametrically opposite to, i.e., substantially 180° spaced from, each other. The partition wall 67 supports on its inner end a shaft seal 58 disposed around the main shaft 7 for preventing the fluid from leaking along the main shaft 7.

The side frame plate 16 has a plurality of ribs 16*a* extending axially upwardly, and a cylindrical inner casing 69 which houses the first-stage impeller 8A and holds a seal 68 is supported on upper ends of the ribs 16*a* around the main shaft 7. An inner casing 70 which houses the third impeller 8C is held on an upper end of the partition wall 67. The inner casing 70 is of a substantially cylindrical-cup shape and comprises a cylindrical wall 70*a* and an upper end cover 70*b* joined to an upper end of the cylindrical wall 70*a*. A resilient annular seal 71 is fixed to and extends around a lower end of the cylindrical wall 70*a*. The resilient annular seal 71 is held against an inner surface of the outer cylinder 2. The cover 70*b* has a central suction opening 70*c* defined therein in communication with the suction mouth of the third-stage impeller 8C.

Liner rings 45 are disposed around the suction mouths of the impellers 8A, 8B, 8C, 8D, respectively, and retained by respective retainers 46 disposed in the inner casings 69, 70. Return blades 47 are disposed downstream of the first- and third-stage impellers 8A, 8C, respectively. Other structural details of the pump shown in FIGS. 4 and 5 are the same as those of the pump shown in FIGS. 1 and 2.

Operation of the vertical multistage pump shown in FIGS. 4 and 5 will be described below.

A fluid which is drawn in through the suction nozzle 5 and the suction port 2*d* flows through the annular fluid passage 40, and then flows through a space between the side frame plate 16 and the retainer 46 into the first-stage impeller 8A. The fluid which is pressurized by the first- and second-stage impellers 8A, 8B is guided by the volute 67*b* to flow through the communication hole 2*a*, the communicating pipe 60C, the communication hole 2*b* into a space defined between the cover 4B and the inner casing 70. The fluid then flows into the third- and final-stage impellers 8C, 8D, which increase the pressure of the fluid. The fluid which is discharged by the final-stage impeller 8D is guided by the volute 67*a*, and discharged through the discharge window 2*c* radially outwardly into the discharge pipe 61. The fluid then flows axially downwardly in the discharge pipe 61, and is discharged through the discharge port 61*a* and then through the discharged nozzle 62 out of the pump.

According to the third embodiment, the communicating pipe 60C welded to the outer circumferential surface of the outer cylinder 2 guides the fluid pressurized by the impellers 8A, 8B to flow from the annular fluid passage 40 into the other space in the outer cylinder 2, from which the fluid is introduced into the impellers 8C, 8D. This structure allows the vertical multistage pump to be constructed as a balanced multistage pump. Since the can 17 is not subject to the discharge pressure of any of the impellers 8A, 8B, 8C, 8D, the canned motor 6 may be of a relatively low pressure resistance and can operate the pump even if it develops a high fluid pressure.

Furthermore, the single volutes 67*a*, 67*b* are associated with the respective impellers 8B, 8D which have oppositely directed suction mouths, and are 180° spaced from each other around the main shaft 7 for canceling out radial loads developed by the fluid discharged by the impellers 8B, 8D. The single volutes 67*a*, 67*b* are effective to guide the fluid more smoothly into the communicating pipe 60 and the discharge pipe 61 that are 180° spaced from each other than guide vanes which would be used to guide the fluid.

If the single volutes 67*a*, 67*b* are integrally formed with each other as a unitary component by the partition wall 67, then they are accurately 180° spaced from each other to prevent radial loads from being developed which would otherwise tend to occur if the single volutes 67*a*, 67*b* were not accurately positioned in 180° spaced-apart relationship. The shaft seal 58 is positioned in an axial hole defined in the partition wall 67 and extending axially through the single volutes 67*a*, 67*b*. The shaft seal 58 thus positioned provides a compact seal structure which is effective to prevent the fluid from leaking. Other advantages of the pump shown in FIGS. 4 and 5 are the same as those of the pump shown in FIGS. 1 and 2.

Figure 6:
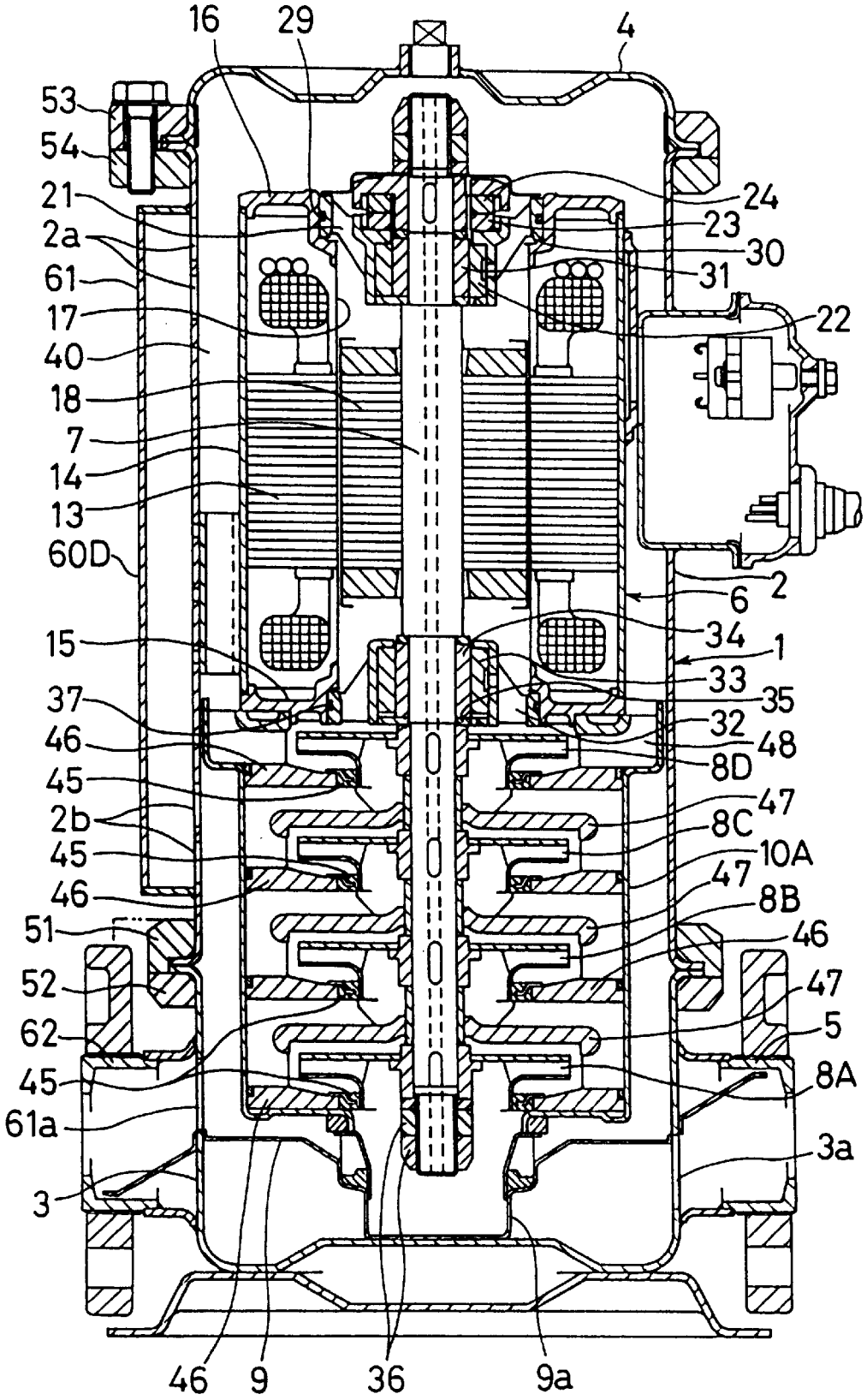
FIG. 6 is a vertical cross-sectional view of a pump according to a fourth embodiment of the present invention.

FIG. 6 shows a pump according to a fourth embodiment of the present invention, the pump being constructed as a single-suction-type multistage pump. Those parts shown in FIG. 6 which are identical to those shown in FIG. 1 are denoted by identical reference numerals, and will not be described in detail below.

The single-suction-type multistage pump comprises a cylindrical pump casing 1 which houses a canned motor 6 centrally therein. The canned motor 6 has a main shaft 7 extending vertically and supporting on a lower end portion thereof a pair of lower impellers 8A, 8B and a pair of upper impellers 8C, 8D. The impellers 8A, 8B, 8C, 8D have respective suction mouths which are open axially downwardly.

The pump casing 1 comprises an outer cylinder 2 of sheet stainless steel, a suction casing 3 of sheet stainless steel joined to a lower end of the outer cylinder 2 by flanges 51, 52, and a cover 4 of sheet stainless steel joined to an upper end of the outer cylinder 2 by flanges 53, 54. The suction casing 3 has a suction port 3*a* defined in a side wall thereof, and a suction nozzle 5 is fixed to the side wall of the suction casing 3 around the suction port 3*a* and projects radially outwardly. A partition wall 9 is fixedly mounted in the suction casing 3 diametrically across the lower end of the main shaft 7 and has a suction opening 9*a* defined in a central axial boss thereof in communication with the suction mouth of the first-stage impeller 8A.

The suction casing 3 and a lower portion of the outer cylinder 2 jointly accommodates an inner casing 10A axially spaced from the partition wall 9 and housing the impellers 8A, 8B, 8C, 8D therein, which are axially spaced from each other. The inner casing 10A also houses therein a plurality of axially spaced retainers 46 positioned underneath the respective impellers 8A, 8B, 8C, 8D, and retaining respective liner rings 45 disposed around respective suction mouths of the impellers 8A, 8B, 8C, 8D, a plurality of return blades 47 positioned axially between the impellers 8A, 8B, 8C, 8D for guiding a fluid discharged from the preceding-stage impellers upwardly toward the subsequent-stage impellers, and a guide unit 48 positioned above the retainer 46 below the final-stage impeller 8D and extending around the impeller 8D, for guiding a fluid discharged radially outwardly from the final-stage impeller 8D to flow axially upwardly.

The outer cylinder 2 has a plurality of axially spaced communication holes 2*a* defined in an upper portion thereof and a plurality of axially spaced communication holes 2*b* defined in a lower portion thereof. The communication holes 2*a*, 2*b* are connected to each other by a communicating pipe or case 60D which is welded to an outer circumferential surface of the outer cylinder 2 in covering relationship to the communication holes 2*a*, 2*b*. Other structural details of the pump shown in FIG. 6 are the same as those of the pump shown in FIGS. 1 and 2.

The single-suction-type multistage pump of the above structure operates as follows:

A fluid which is drawn in through the suction nozzle 5 and the suction port 3*a* flows through the suction opening 9*a* into the impellers 8A, 8B, 8C, 8D, which increase the pressure of the fluid. The fluid which is discharged radially outwardly from the final-stage impeller 8D is guided by the guide unit 48 to flow axially upwardly. The fluid is then introduced upwardly into the annular fluid passage 40 between the outer cylinder 2 and the cylindrical outer motor frame 14, and then flows from the annular fluid passage 40 through the communication hole 2*a*, the communicating pipe 60D, the communication hole 2*b* into a space defined between the outer cylinder 2, the suction casing 3, and the inner casing 10A. The fluid then flows through the above space into the discharge port 61*a*, from which the fluid is discharged through the discharged nozzle 62 out of the pump.

According to the fourth embodiment, the communicating pipe 60D welded to the outer circumferential surface of the outer cylinder 2 guides the fluid pressurized by the impellers 8A, 8B, 8C, 8D to flow from the annular fluid passage 40 into the space defined between the outer cylinder 2, the suction casing 3, and the inner casing 10A. The communicating pipe 60D thus provided serves to reduce the outside diameter of the outer cylinder 2. Other advantages of the pump shown in FIG. 6 are the same as those of the pump shown in FIGS. 1 and 2.

As is apparent from the above description, the first through fourth embodiments of the present invention offer the following advantages:

(1) The embodiments offer a pump which has a relatively simple structure in an outer casing, but allows itself to be designed in a wide range of pump configurations including a balanced multistage pump.

(2) The embodiments offers a pump which has a required fluid passage area and is relatively small in size without the need for an increase in the general outside diameter of an outer casing.

(3) The embodiments offers a multistage full-circumferential-flow canned-motor pump which has a common shaft serving as both a motor shaft and a pump shaft, the pump being capable of pumping a fluid at a low flow rate under a high pump head.

(4) The embodiments offers a balanced multistage pump which has a simple arrangement for canceling out radial loads.

Figure 7:
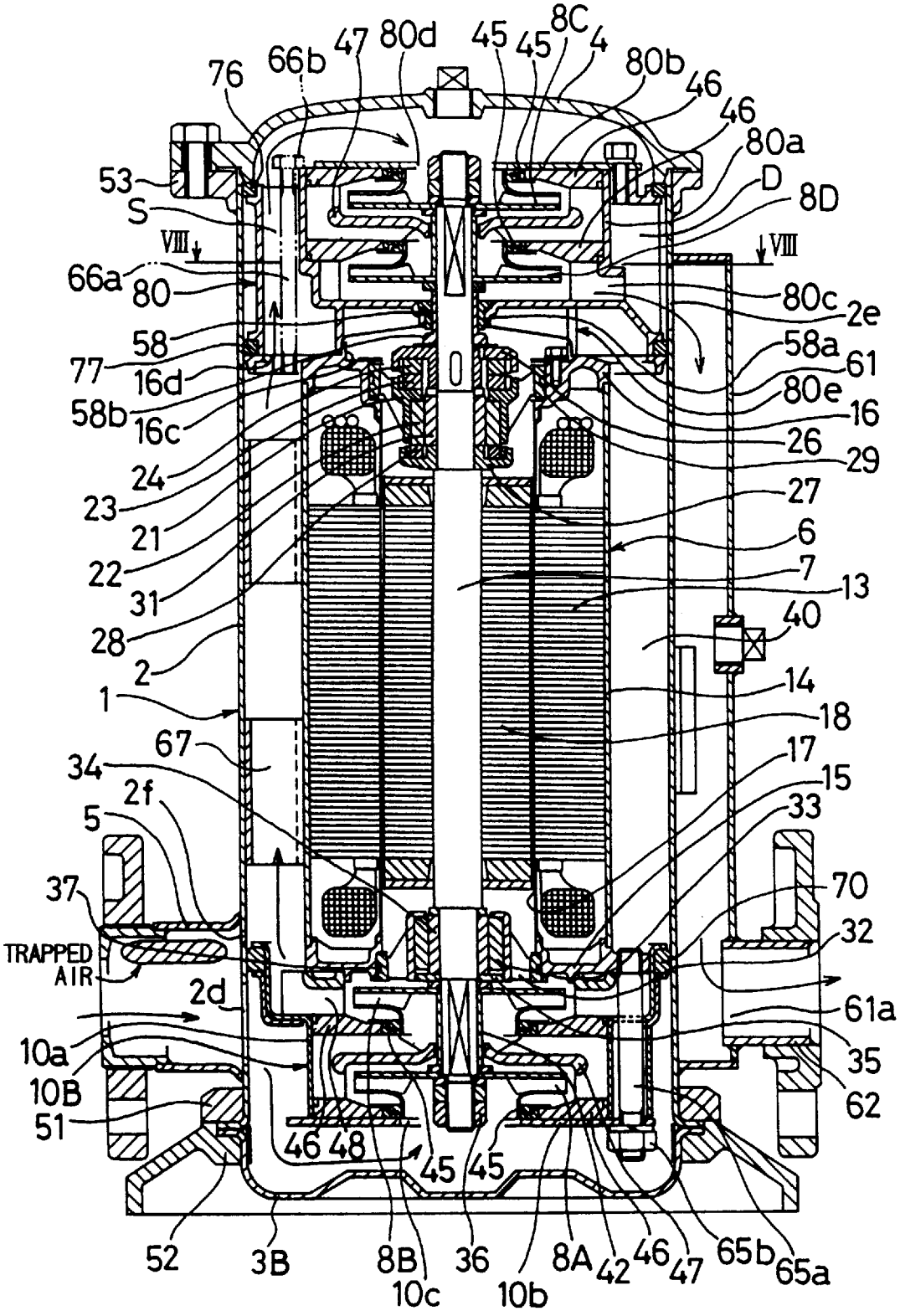
FIG. 7 is a vertical cross-sectional view of a pump according to an embodiment of the present invention.
Figure 8:
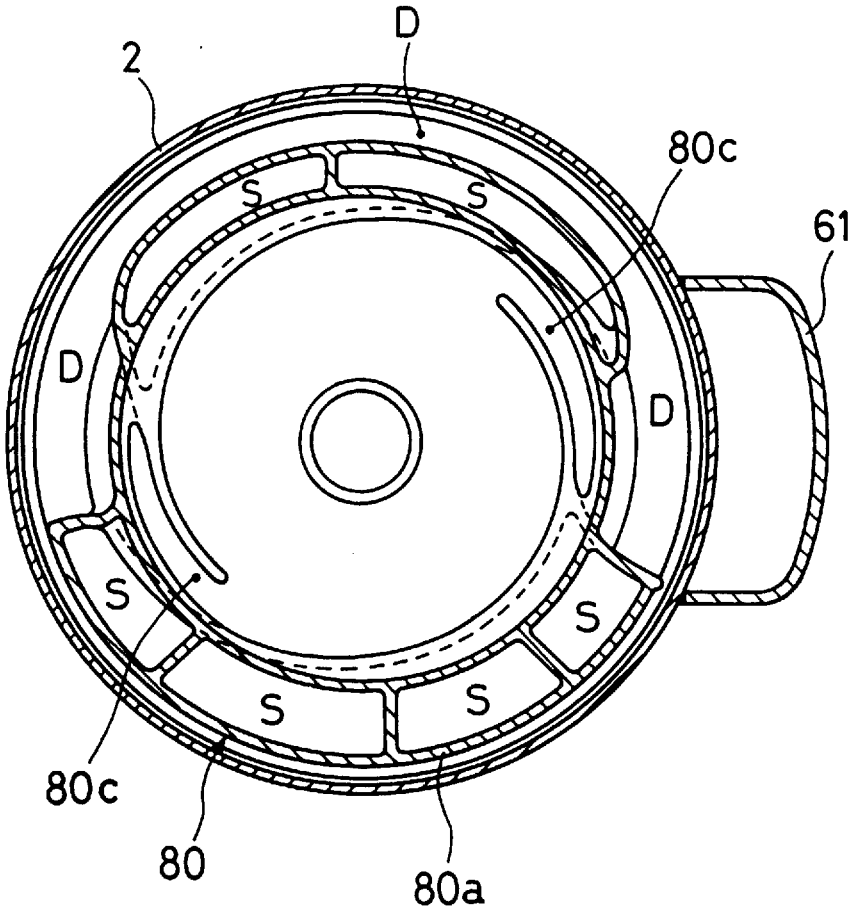
FIG. 8 is a cross-sectional view taken along line VIII—VIII of FIG. 7.

FIGS. 7 and 8 show a pump according to a fifth embodiment of the present invention, the pump being constructed as a vertical multistage pump.

The vertical multistage pump comprises a cylindrical pump casing 1 which houses a canned motor 6 centrally therein. As shown in FIG. 7, the canned motor 6 has a main shaft 7 extending vertically and supporting on its opposite end portions respective pairs of lower impellers 8A, 8B and upper impellers 8C, 8D. The lower impellers 8A, 8B have respective suction mouths which are open axially downwardly, and the upper impellers 8C, 8D have respective suction mouths which are open axially upwardly. The impellers 8A, 8B, 8C, 8D will also be referred to as first-, second-, third-, and fourth- or final-stage impellers, respectively.

The pump casing 1 comprises an outer cylinder 2 of sheet stainless steel, a lower casing cover 3B of sheet stainless steel joined to a lower end of the outer cylinder 2 by flanges 51, 52, and an upper casing cover 4 of cast stainless steel joined to a flange 53 of cast stainless steel which is welded to an upper end of the outer cylinder 2. The outer cylinder 2 has a suction port 2*d* defined in a lower side wall thereof, and a suction nozzle 5 is fixed to the lower side wall of the outer cylinder 2 around the suction port 2*d* and projects radially outwardly. The outer cylinder 2 also has an air vent hole 2*f* defined therein above the suction port 2*d* and opening into the suction nozzle 5 for preventing air from being trapped in the suction nozzle 5.

A lower inner casing 10B is fixedly mounted in a space that is defined between a lower end portion of the outer cylinder 2 and the lower casing cover 3B. A fluid being handled by the pump is drawn through the suction nozzle 5 and the suction port 2*d* into a space defined between the lower inner casing 10B and the lower casing cover 3B.

The lower inner casing 10B comprises a cylindrical member 10*a* and a flat cover 10*b* mounted on a lower end of the cylindrical member 10*a* and having a central port 10*c* defined therein in communication with the suction mouth of the first-stage impeller 8A. A resilient annular seal 70 is fixed to and extends around an upper end of the lower inner casing 10B, and is held against an inner surface of the outer cylinder 2 for isolating a fluid under suction pressure from a fluid under discharge pressure. The lower inner casing 10B is fastened to a side frame plate 15 of the canned motor 6 by a bolt 65*a* and a nut 65*b*. The lower inner casing 10B houses the lower impellers 8A, 8B therein, which are axially spaced from each other. The lower inner casing 10B also houses therein a pair of axially spaced retainers 46 positioned underneath the lower impellers 8A, 8B, respectively, and retaining respective liner rings 45 disposed around respective suction mouths of the lower impellers 8A, 8B, a return blade 47 positioned axially between the impeller 8A and the upper retainer 46 located underneath the impeller 8B, for guiding a fluid discharged from the first-stage impeller 8A upwardly toward the second-stage impeller 8B, and a guide unit 48 positioned above the upper retainer 46 and extending around the impeller 8B, for guiding a fluid discharged radially outwardly from the second-stage impeller 8B to flow axially upwardly.

The canned motor 6 is the same as that in FIGS. 1 and 2. The side frame plate 16 of the canned motor 6 has a fitting member 16*c* which supports an upper inner casing 80 that is positioned in a space defined between an upper end portion of the outer cylinder 2 and the upper casing cover 4. The side frame plate 16 also has an annular window 16*d* defined therein which communicates with the annular fluid passage 40 for passing therethrough a fluid flowing from the annular fluid passage 40. The upper inner casing 80, which is made of cast stainless steel, comprises a double-walled cylindrical main body 80*a* (see also FIG. 8) and a cover 80*b* mounted on an upper end of the double-walled cylindrical main body 80*a*. The double-walled cylindrical main body 80*a* houses therein the third- and fourth-stage impellers 8C, 8D, which are axially spaced from each other. The double-walled cylindrical main body 80*a* defines a plurality of divided suction passages S that extend axially. The upper inner casing 80 has two diametrically opposite discharge volutes 80*c* disposed in the double-walled cylindrical main body 80*a*.

The discharge volutes 80*c* are positioned in surrounding relationship to the fourth- or final-stage impeller 8D. The discharge volutes 80*c* are held in communication with a discharge passage D that is defined between the upper inner casing 80 and the outer cylinder 2. A fluid that is discharged from the final-stage impeller 8D flows through the discharge volutes 80*c* into the discharge passage D. The double-walled cylindrical main body 80*a* supports on its inner end a shaft seal 58 which is composed of a sleeve 58*a* held by the double-walled cylindrical main body 80*a* and a bushing 58*b* disposed around the main shaft 7 and held in the sleeve 58*a*.

Resilient seal rings 76, 77 are fixed respectively to upper and lower ends of the double-walled cylindrical main body 80*a* and held against the inner surface of the outer cylinder 2 for preventing a fluid from leaking from a discharge region back into a suction region in the pump. The cover 80*b* has a central suction opening 80*d* defined therein in communication with the suction mouth of the third-stage impeller 8C. The double-walled cylindrical main body 80*a* has a recess 80*e* defined in a lower portion thereof to provide communication between the rotor chamber of the canned motor 6 and the annular fluid passage 40.

The upper inner casing 80 is fixed to the side frame plate 16 of the canned motor 6 by a bolt 66*a* and a nut 66*b*. The upper inner casing 80 houses therein a pair of axially spaced retainers 46 positioned above the upper impellers 8C, 8D, respectively, and retaining respective liner rings 45 fitted over respective upper ends of the upper impellers 8C, 8D, and a return blade 47 positioned axially between the impeller 8C and the lower retainer 46 located above the impeller 8D, for guiding a fluid discharged from the third-stage impeller 8C downwardly toward the final-stage impeller 8D. The retainers 46 and the return blade 47 housed in the upper inner casing 80 are identical to the retainers 46 and the return blade 47 housed in the lower inner casing 10B.

The outer cylinder 2 has a discharge window 2*e* defined in an upper portion thereof in communication with the discharge passage D. The discharge window 2*e* is covered with a discharge case 61 which is welded to an outer circumferential surface of the outer cylinder 2. The discharge case 61 extends downwardly to a lower portion of the outer cylinder 2, and has a discharge port 61*a* defined in a lower end thereof. A discharge nozzle 62 is fixed to a lower side wall of the discharge case 61 around the discharge port 61*a* and projects radially outwardly.

Other structural details of the pump shown in FIGS. 7 and 8 are the same as those of the pump shown in FIGS. 1 and 2.

Operation of the vertical multistage pump shown in FIGS. 7 and 8 will be described below.

A fluid which is drawn in through the suction nozzle 5 and the suction port 2*d* flows through the suction opening 10*c* into the first- and second-stage impellers 8A, 8B, which increase the pressure of the fluid. The fluid which is discharged radially outwardly from the second-stage impeller 8B is guided by the guide unit 48 to flow axially upwardly. The fluid is then introduced upwardly into the annular fluid passage 40 between the outer cylinder 2 and the cylindrical outer motor frame 14, and then flows from the annular fluid passage 40 through the annular window 16*d* and the suction passages S into a space defined between the upper inner casing 80 and the upper casing cover 4. The fluid then flows downwardly through the suction opening 80*d* into the third- and final-stage impellers 8C, 8D, which increase the pressure of the fluid. The fluid which is discharged by the final-stage impeller 8D is guided by the discharge volutes 80*c* to flow into the discharge passage D, and discharged through the discharge window 2*e* radially outwardly into the discharge case 61. The fluid then flows axially downwardly in the discharge case 61, and is discharged through the discharge port 61*a* and then through the discharged nozzle 62 out of the pump.

According to the present invention, the pump includes the cylindrical outer motor frame 14 disposed around the stator 13 of the canned motor 6, the outer cylinder 2 which defines the annular fluid passage 40 between itself and the outer circumferential surface of the cylindrical outer motor frame 14, and a first pump section composed of the impellers 8A, 8B for guiding a fluid being handled into the annular fluid passage 40. Furthermore, the upper inner casing 80, which houses a second pump section composed of the impellers 8C, 8D, has the suction passages S, and the discharge passage D is defined between the upper inner casing 80 and the outer cylinder 2.

The suction passages S defined in the upper inner casing 80 serve to guide the fluid discharged from the impeller 8B of the first pump section and flowing away from the canned motor 6 into the suction mouth of the third-stage impeller 8C that is positioned remotely from the canned motor 6. The discharge passage D defined between the upper inner casing 80 and the outer cylinder 2 guides the discharged fluid to flow therethrough out of the outer cylinder 2. This fluid passage arrangement results in a structure for balancing axial thrust forces in the pump.

Furthermore, the above fluid passage arrangement dispenses with any pipes for introducing the fluid from the first pump section to the second pump section, allowing the pump to be easily constructed as a balanced single-suction-type multistage pump.

If a single-suction-type pump is to be operated at a high speed of at least 4000 rpm through the use of an inverter or the like, then it is important for the pump to keep a desired suction performance. According to the present invention, the first-stage impeller 8A has a larger design-point flow rate or capacity than any of the other impellers 8B, 8C, 8D. Specifically, the first-stage impeller 8A has a suction mouth diameter $D_1$ which is larger than the suction mouth diameter of any of the other impellers 8B, 8C, 8D, and the first-stage impeller 8A has a blade width $B_2$ larger than the blade width of the other impellers 8B, BC, 8D. Generally, a comparison between impellers having identical outside diameters but different suction mouth diameters indicates that the impeller with the greater suction mouth diameter has a better suction performance than the impeller with the smaller suction mouth diameter at the same flow rate point. The overall flow rate of a multistage pump is substantially governed by an impeller having a smaller flow rate which is incorporated therein. Therefore, it is possible for the single-suction-type pump which is operated at a high speed to keep a desired suction performance.

It is also of importance for a pump which is operated at a high speed to cancel out axial thrust forces as well as to balance radial loads. If the pump is operated at a high speed while bearings of the pump are being subjected to radial loads, then the bearings tend to wear soon. Accordingly, the pump is required to be of such a structure capable of balancing and canceling out radial loads.

According to the present invention, such radial loads are canceled out by employing a double volute construction composed of the discharge volutes 80*c* associated with the final-stage impeller 8D in the upper inner casing 80, and also by constructing the return blade 47 and the guide unit 48 associated with the other impellers 8A, 8B, 8C as volutes or guide vanes.

According to the present invention, furthermore, since the upper inner casing 80 is composed of a casting made of cast stainless steel, it may be constructed as a relatively complex unitary component with the suction passages S and the discharge passage D defined therein. Because the suction mouths of the impellers 8A, 8B and the suction mouths of the impellers 8C, 8D are oriented in opposite directions, and the upper inner casing 80 is employed, the pump can be constructed as a balanced single-suction-type multistage pump.

Moreover, the two resilient seal rings 76, 77 are mounted on the upper inner casing 80 with the discharge passage D interposed therebetween for preventing the fluid from leaking from the discharge passage D into the suction passages S. In the case where the first and second pump sections are positioned on the opposite ends of the main shaft 7 of the canned motor 6, a suction case with a suction port or the discharge case 61 (only the discharge case 61 is shown in FIG. 7) with the discharge port 61*a* is effective to align the suction and discharge ports positionally with each other.

An intermediate fluid pressure increased by the impellers 8A, 8B of the first pump section acts on the can 17 of the canned motor 6. However, the final discharge pressure achieved by the impellers 8C, 8D of the second pump sections does not act on the can 17. The shaft seal 58 is mounted a portion of the main shaft 7 which is positioned between the space in which the final discharge pressure is developed and the space in which the intermediate fluid pressure is developed, for thereby limiting the amount of fluid leaking from the former space into the latter space.

The first pump section composed of the impellers 8A, 8B has a greater design flow rate or capacity than the second pump section composed of the impellers 8C, 8D. Generally, a pump (impeller) having a greater design flow rate has a better suction performance than a pump (impeller) having a smaller design flow rate when they are operated at the same flow rate. The overall flow rate of the pump is substantially determined by the second pump section which has a smaller design flow rate. Therefore, by making a flow rate range achieved when only the first pump section operates, greater than a flow rate range achieved when only the second pump section operates, the pump can maintain a desired suction performance even when it is operated at a high speed.

Further according to the present invention, the seal ring 76 is disposed in a space surrounded by three components, i.e., the upper inner casing 80, the outer cylinder 2, and the upper casing cover 4, and the other seal ring 77 is disposed in a space surrounded by three components, i.e., the upper inner casing 80, the outer cylinder 2, and the side frame plate 16. The seal rings 76, 77 are made of a resilient material such as rubber, and are gripped in position while being axially tightened. Before the upper inner casing 80 is inserted into the outer cylinder 2, the seal rings 76, 77 are fitted over the upper inner casing 80. At this time, the seal rings 76, 77 are not axially tightened, and have an outside diameter slightly smaller than the inside diameter of the outer cylinder 2, so that the upper inner casing 80 can easily be inserted into the outer cylinder 2. When the upper inner casing 80 is assembled in the outer cylinder 2, the seal ring 77 held against the side frame plate 16 is axially tightened by the bolt 66*a* and the nut 66*b*, and the seal ring 76 is axially tightened by the upper casing cover 4 which is fastened to the flange 53. Therefore, the seal rings 76, 77 are axially tightened, increasing their outside diameter, so that their outer circumferential surfaces are brought into intimate contact with the inner surface of the outer cylinder 2 for thereby providing a desired sealing capability.

The internal components, including the outer motor frame 14 and the side frame plates 15, 16, of the pump are liable to move axially downwardly in FIG. 7 with respect to the outer cylinder 2 due to forces developed by a certain pressure distribution created therein. Such forces cannot sufficiently be borne simply by welding the frame stay 67 to the outer cylinder 2 and the outer motor frame 14.

According to the present invention, the side frame plate 16 extends radially outwardly and is welded to the outer cylinder 2 for sufficiently bearing the above forces. In FIG. 7, the fluid pressure developed by the final-stage impeller 8D acts in a space defined axially between the seal rings 76, 77. Therefore, a portion of the outer cylinder 2 which surround the space between the seal rings 76, 77 is exposed to an internal pressure greater than the internal pressure in the other portion of the outer cylinder 2. It is highly effective to weld the side frame plate 16 to the outer cylinder 2 for mechanically sustaining that portion of the outer cylinder 2 which surround the space between the seal rings 76, 77. The casing flange 53 welded to the upper end of the outer cylinder 2 is effective in preventing the outer cylinder 2 from being expanded radially outwardly.

The air vent hole 2*f* defined in the outer cylinder 2 above the suction port 2*d* and opening into the suction nozzle 5 serves to prevent air from being trapped in the suction nozzle 5.

Generally, single-suction-type multistage pumps, particularly those which are operated at high speed, are of poor suction performance. Consequently, the principles of the present invention are effective in improving the suction performance of general pumps other than full-circumferential-flow pumps.

As is apparent from the above description, the fifth embodiment of the present invention offers the following advantages:

(1) The embodiment offers a full-circumferential-flow single-suction-type pump of simple structure which can cancel out axial thrust loads developed therein and can pump a fluid at a low flow rate under a high pump head.

(2) The embodiment offers a pump which maintains a desired suction performance when it operated at high speed.

(3) The embodiment offers a pump which cancel out radial loads developed therein.

Although certain preferred embodiments of the present invention have been shown and described in detail, it should be understood that various changes and modifications may be made therein without departing from the scope of the appended claims.

What is claimed is:

1. A multistage pump comprising:

an outer casing;

a plurality of impellers housed in said outer casing and having respective suction mouths, said impellers including at least one impeller whose suction mouth is open in a direction opposite to the direction in which the suction mouth of another impeller is open, for thereby reducing an axial thrust force developed by said impellers; and two single volutes associated respectively with said at least one impeller whose suction mouths are open in the opposite directions, respectively, said single volutes having respective ends where they start or stop winding, which are positioned substantially 180° spaced from each other for thereby canceling out radial loads developed by said impellers.

2. A multistage pump according to claim 1, wherein said two single volutes are integrally formed with each other as a unitary component.

3. A multistage pump according to claim 2, further comprising a shaft seal disposed in an axial hole passing through said two single volutes for preventing the fluid from leaking through said axial hole.

4. A pump having an improved fluid passage comprising:

an outer casing;

a motor housed in said outer casing, said motor including a shaft, a stator disposed around said shaft and a cylindrical outer motor frame fitted over said stator and fixedly supported in said outer casing;

an annular space defined between said outer casing and said cylindrical outer motor frame;

an inner casing provided in said outer casing; and a first pump section having at least one impeller mounted on an end of said shaft; and a second pump section having at least one impeller mounted on another end of said shaft;

wherein said impellers of said first and second pump sections have respective suction mouths opening in opposite directions, said inner casing accommodating said impeller of said second pump section has a suction passage defined therein in communication with said annular space, and said inner casing and said outer casing define a discharge passage therebetween for discharging the fluid from said second pump section.

5. A pump having an improved fluid passage according to claim 4, wherein said inner casing comprises a casting with said suction passage integrally defined therein.

6. A pump having an improved fluid passage according to claim 4, further comprising two seal members positioned one on each side of said discharge passage for preventing a fluid from leaking from said discharge passage into said suction passage.

7. A pump having an improved fluid passage according to claim 4, further comprising a plurality of discharge volutes disposed in said inner casing for canceling out radial loads developed in said inner casing.

8. A pump having an improved fluid passage according to claim 4, further comprising one of a suction case and a discharge case mounted on an outer surface of said outer casing for connection to one of suction and discharge ports of the pump.

9. A pump having an improved fluid passage according to claim 4, wherein said motor comprises a canned motor including a can fitted in said stator, said can being subject to only a pressure increased by said first pump section.

10. A pump having an improved fluid passage according to claim 4, wherein a flow rate range achieved when only said first pump section is operated is greater than a flow rate range achieved when only said second pump section is operated.

11. A pump having an improved fluid passage according to claim 4, wherein at least one impeller of said first pump section has a suction mouth diameter greater than a suction mouth diameter of the impeller of said second pump section.

12. A pump having an improved fluid passage according to claim 6, wherein at least one of said two seal members is disposed in a space surrounded by said inner casing, an outer cylinder, and a casing cover mounted on an end of said outer cylinder.

13. A pump having an improved fluid passage according to claim 4, wherein said motor includes a side frame plate mounted on an end of said cylindrical outer motor frame, said side frame plate extending radially outwardly and welded to said outer casing, said side frame plate having a window for allowing fluid to pass therethrough.

14. A pump having an improved fluid passage comprising;

an outer casing;

a motor housed in said outer casing, said motor including a stator and a cylindrical outer motor frame fitted over said stator and fixedly supported in said outer casing;

an annular space defined between said outer casing and said outer motor frame, said outer casing comprising a first outer casing member which defines said annular space between said first outer casing member and said cylindrical outer motor frame, and a second outer casing member mounted on at least one axial end of said first outer casing member; and a single-suction-type multistage pump section having a plurality of impellers disposed in said outer casing, said impellers including at least one impeller whose suction mouth is open in a direction opposite to the direction in which the suction mouth of another impeller is open, wherein said motor comprises a canned motor having a shaft, a can disposed in said stator and defining a rotor chamber therein, and a rotor mounted on said shaft and rotatably disposed in said rotor chamber, said shaft is rotatably supported by a plurality of bearing assemblies disposed in said rotor chamber, and said bearing assemblies are lubricated by a part of fluid which is introduced into said rotor chamber.

15. A pump having an improved fluid passage according to claim 14, wherein said impellers are arranged such that a discharge pressure developed by all of said impellers is not applied to said can.

16. A pump having an improved fluid passage comprising;

an outer casing;

a motor housed in said outer casing, said motor including a stator and a cylindrical outer motor frame fitted over said stator and fixedly supported in said outer casing;

an annular space defined between said outer casing and said outer motor frame, said outer casing comprising a first outer casing member which defines said annular space between said first outer casing member and said cylindrical outer motor frame, and a second outer casing member mounted on at least one axial end of said first outer casing member; and a single-suction-type multistage pump section having a plurality of impellers disposed in said outer casing, said impellers including at least one impeller whose suction mouth is open in a direction opposite to the direction in which the suction mouth of another impeller is open, wherein said annular space is arranged such that a uniform fluid pressure is applied to said cylindrical outer motor frame.

17. A pump having an improved fluid passage comprising:

an outer casing;

a motor housed in said outer casing, said motor including a stator and a cylindrical outer motor frame fitted over said stator and fixedly supported in said outer casing;

an annular space defined between said outer casing and said cylindrical outer motor frame;

an inner casing provided in said outer casing; and a pump section having at least one impeller disposed in said inner casing;

wherein said inner casing has a suction passage defined therein in communication with said annular space for introducing fluid into said pump section, and said inner casing and said outer casing define a discharge passage therebetween for discharging the fluid from said pump section, further comprising two seal members positioned one on each side of said discharge passage for preventing a fluid from leaking from said discharge passage into said suction passage.

18. A pump having an improved fluid passage comprising:

an outer casing;

a motor housed in said outer casing, said motor including a stator and a cylindrical outer motor frame fitted over said stator and fixedly supported in said outer casing;

an annular space defined between said outer casing and said cylindrical outer motor frame;

an inner casing provided in said outer casing; and a pump section having at least one impeller disposed in said inner casing;

wherein said inner casing has a suction passage defined therein in communication with said annular space for introducing fluid into said pump section, and said inner casing and said outer casing define a discharge passage therebetween for discharging the fluid from said pump section, further comprising a plurality of discharge volutes disposed in said inner casing for canceling out radial loads developed in said inner casing.

* * * * *